US008668527B2

(12) United States Patent
Zhang

(10) Patent No.: US 8,668,527 B2
(45) Date of Patent: Mar. 11, 2014

(54) ELECTRICAL CONNECTOR WITH IMPROVED CONTACT-LOADING MANNER FOR COPLANARITY ADJUSTMENT

(75) Inventor: Han-Ming Zhang, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 47 days.

(21) Appl. No.: 13/413,624

(22) Filed: Mar. 6, 2012

(65) Prior Publication Data

US 2012/0231675 A1 Sep. 13, 2012

(30) Foreign Application Priority Data

Mar. 8, 2011 (CN) ..... 2011 2 0058064

(51) Int. Cl.
*H01R 24/00* (2011.01)

(52) U.S. Cl.
USPC ..... 439/660

(58) Field of Classification Search
USPC ..... 439/660
See application file for complete search history.

(56) References Cited

U.S. PATENT DOCUMENTS 8,109,795 B2 * 2/2012 Lin et al. ..... 439/660
8,147,276 B2 * 4/2012 Wang et al. ..... 439/660
8,382,519 B2 * 2/2013 Lin et al. ..... 439/607.01
2010/0173529 A1 * 7/2010 He et al. ..... 439/660
2011/0065325 A1 * 3/2011 Hsu et al. ..... 439/638
2011/0097933 A1 4/2011 Sommers et al.
2011/0281468 A1 * 11/2011 Yu et al. ..... 439/660

FOREIGN PATENT DOCUMENTS

TW M380631 5/2010
TW I353088 11/2011

* cited by examiner

*Primary Examiner* — Gary Paumen

(74) *Attorney, Agent, or Firm* — Wei Te Chung; Ming Chieh Chang

(57) ABSTRACT

An electrical connector includes an insulative housing and a number of upper and lower contacts fixed in the insulative housing. The insulative housing includes a base and a tongue portion extending from the base along a first direction. Each of the upper contacts includes a first planar soldering section situated adjacent to a bottom face of the base. Each of the lower contacts includes a second planar soldering section situated adjacent to the bottom face of the base. The lower contacts are assembled to the insulative housing along a second direction perpendicular to the first direction in order that the second planar soldering sections can be kept coplanar with the first planar soldering sections through controlling insertion depth of the lower contacts along the second direction.

20 Claims, 6 Drawing Sheets

ELECTRICAL CONNECTOR WITH IMPROVED CONTACT-LOADING MANNER FOR COPLANARITY ADJUSTMENT

BACKGROUND OF THE INVENTION

1. Field of the Invention

The present invention relates to an electrical connector, and more particularly to an electrical connector with contacts loaded from different directions for adjusting coplanarity.

2. Description of Related Art

Port connectors, such as HDMI connectors, are standardized and widely used in multiple electronic devices. Taiwan Patent Issue No. M380631 issued on May 11, 2010, discloses a conventional electrical connector including an insulative housing and a number of contacts assembled to the insulative housing. The insulative housing includes a base and a tongue plate extending from the base. The tongue plate defines a plurality of upper slits and lower slits on top and bottom surfaces thereof, respectively. The contacts include a plurality of first contacts received in the upper slits and a plurality of second contacts received in the lower slits when the first contacts and the second contacts are inserted into the insulative housing along a rear-to-front direction. Since the first contacts have SMT type soldering sections and the second contacts have Through-Hole type soldering sections, such assembling method may not render much trouble. However, one electrical connector with two different kinds of soldering sections may complicate soldering procedures and is less effective.

Electrical connectors with SMT type contacts are widely applied in current mobile device, not only because such SMT type contacts are easy for automatically soldering, but also because such SMT type contacts usually save space. However, it is a serious problem that how to keep all the SMT type contacts coplanarity.

Hence, it is desirable to provide an electrical connector with improved contact loading for achieving good coplanarity.

BRIEF SUMMARY OF THE INVENTION

The present invention provides an electrical connector including an insulative housing and a plurality of upper and lower contacts fixed in the insulative housing. The insulative housing includes a base and a tongue portion extending from the base along a first direction. Each of the upper contacts includes a first planar soldering section situated adjacent to a bottom face of the base. Each of the lower contacts includes a second planar soldering section situated adjacent to the bottom face of the base. The lower contacts are assembled to the insulative housing along a second direction perpendicular to the first direction in order that the second planar soldering sections can be kept coplanar with the first planar soldering sections through controlling insertion depth of the lower contacts along the second direction.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
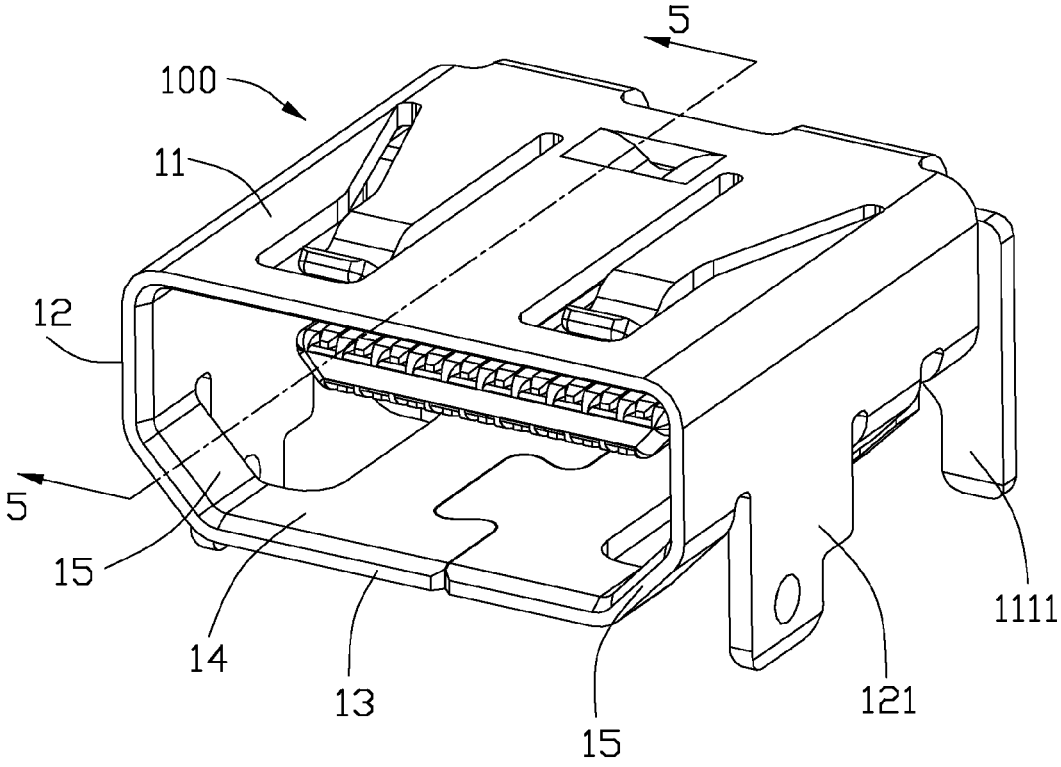
FIG. 1 is a perspective view of an electrical connector in accordance with an illustrated embodiment of the present invention.
Figure 2:
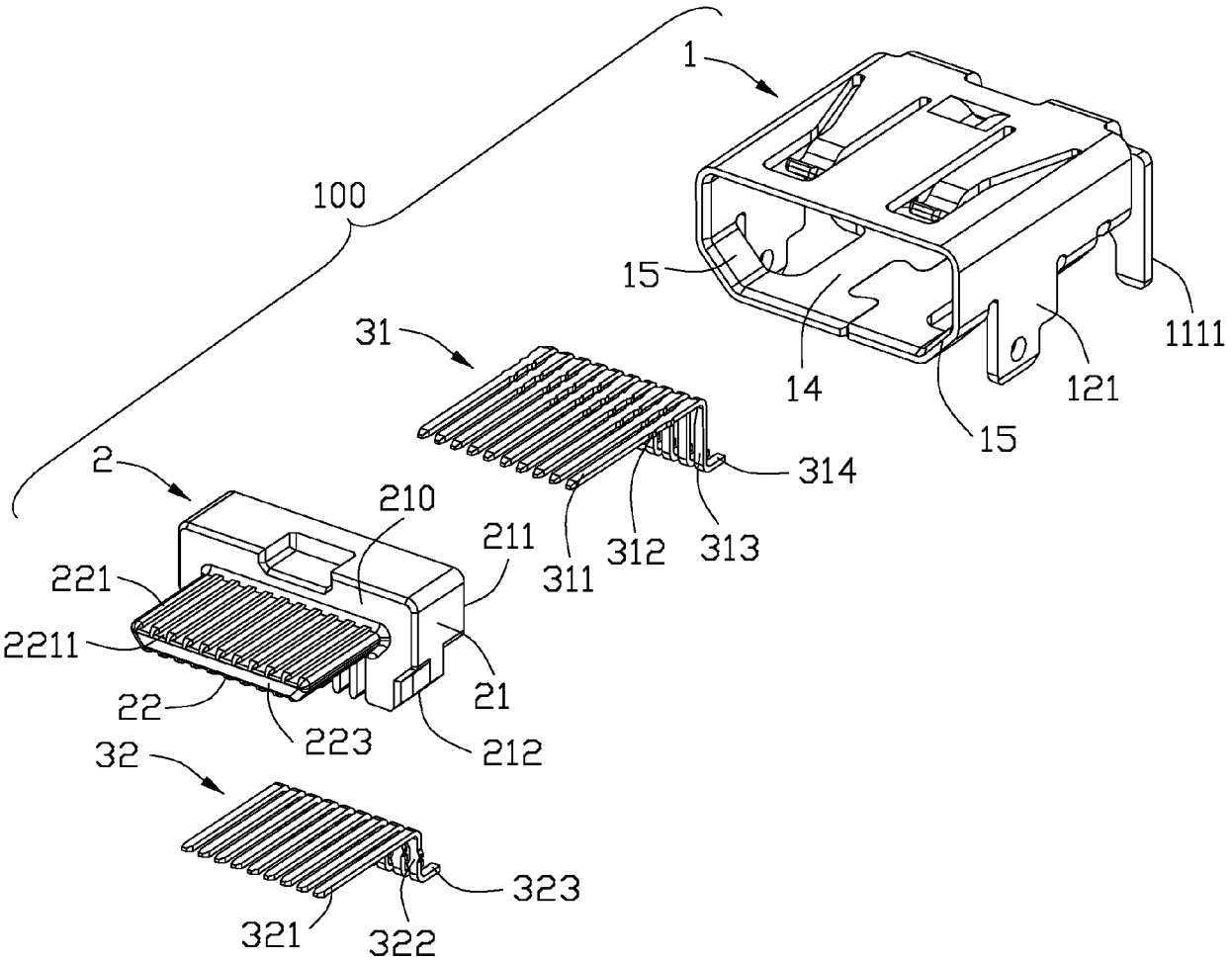
FIG. 2 is an exploded view of the electrical connector as shown in FIG. 1.
Figure 3:
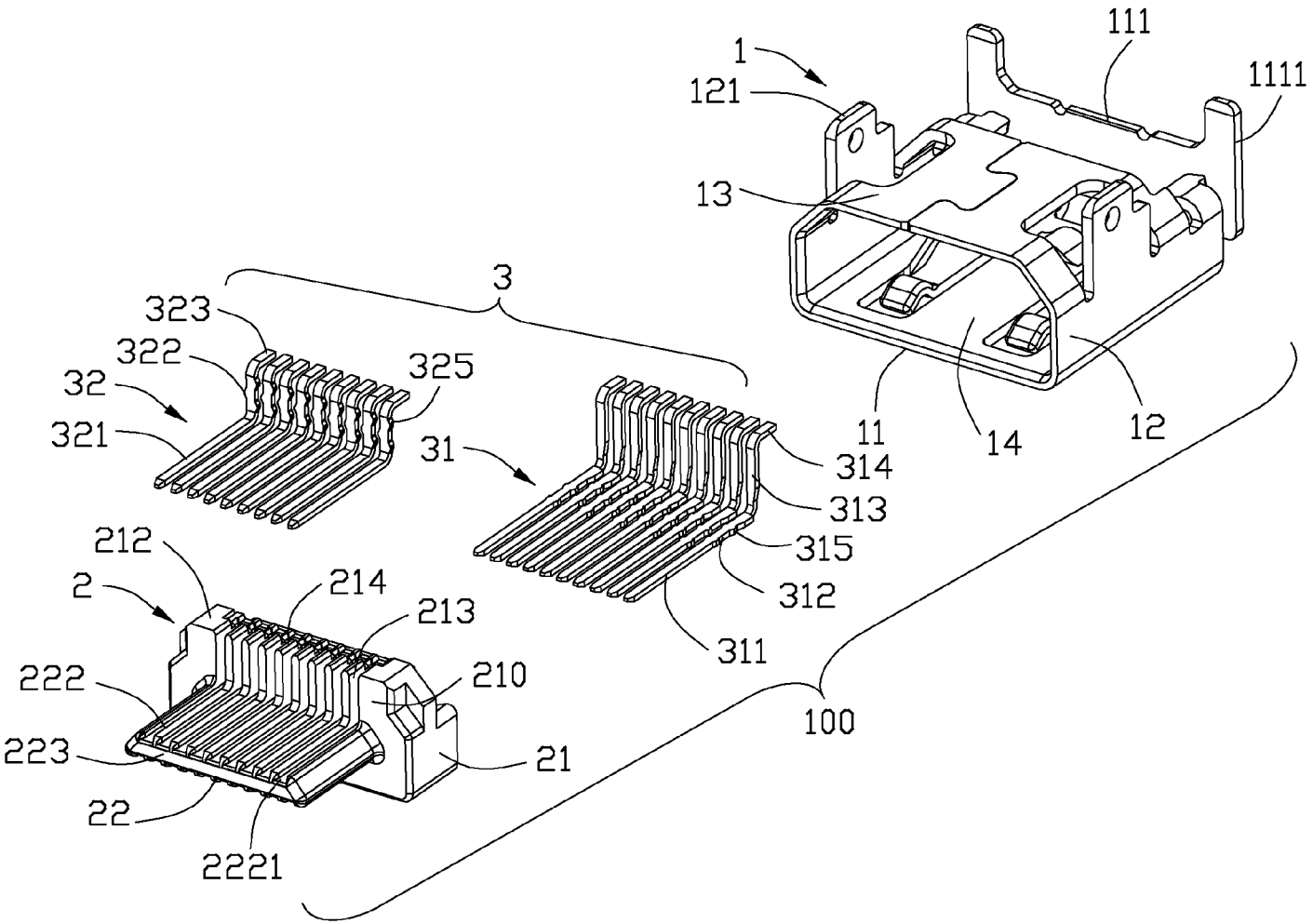
FIG. 3 is another exploded view of the electrical connector.

Reference will now be made to the drawing figures to describe the preferred embodiment of the present invention in detail. Referring to FIGS. 1 to 6, the illustrated embodiment of the present invention discloses an electrical connector 100 including an insulative housing 2, a plurality of contacts 3 fixed in the insulative housing 2 and a metal shell 1 enclosing the insulative housing 2. According to the illustrated embodiment of the present invention, the electrical connector 100 is a HDMI receptacle connector and is adapted for mounting on a PCB.

Referring to FIGS. 2 to 6, the insulative housing 2 includes a base 21 and a tongue portion 22 extending forwardly from the base 21 along a longitudinal direction. The base 21 includes a front face 210, a rear face 211 and a bottom face 212. The tongue portion 22 includes a front end 223, a top surface 221 and a bottom surface 222. A plurality of first/upper slits 2211 are defined on the top surface 221 and further extending through the front end 223 along the longitudinal direction. Similarly, a plurality of second/lower slits 2221 are defined on the bottom surface 222 and further extending through the front end 223 along the longitudinal direction. The first slits 2211 and the second slits 2221 are offset from each other along a transverse direction perpendicular to the longitudinal direction. The base 21 defines a plurality of first grooves 215 in communication with corresponding first slits 2211. Each of the first grooves 215 extends along the longitudinal direction and through the rear face 211 of the base 21. Besides, a rectangular rear opening 216 is formed on the rear face 211 and in communication with the first grooves 215.

Figure 4:
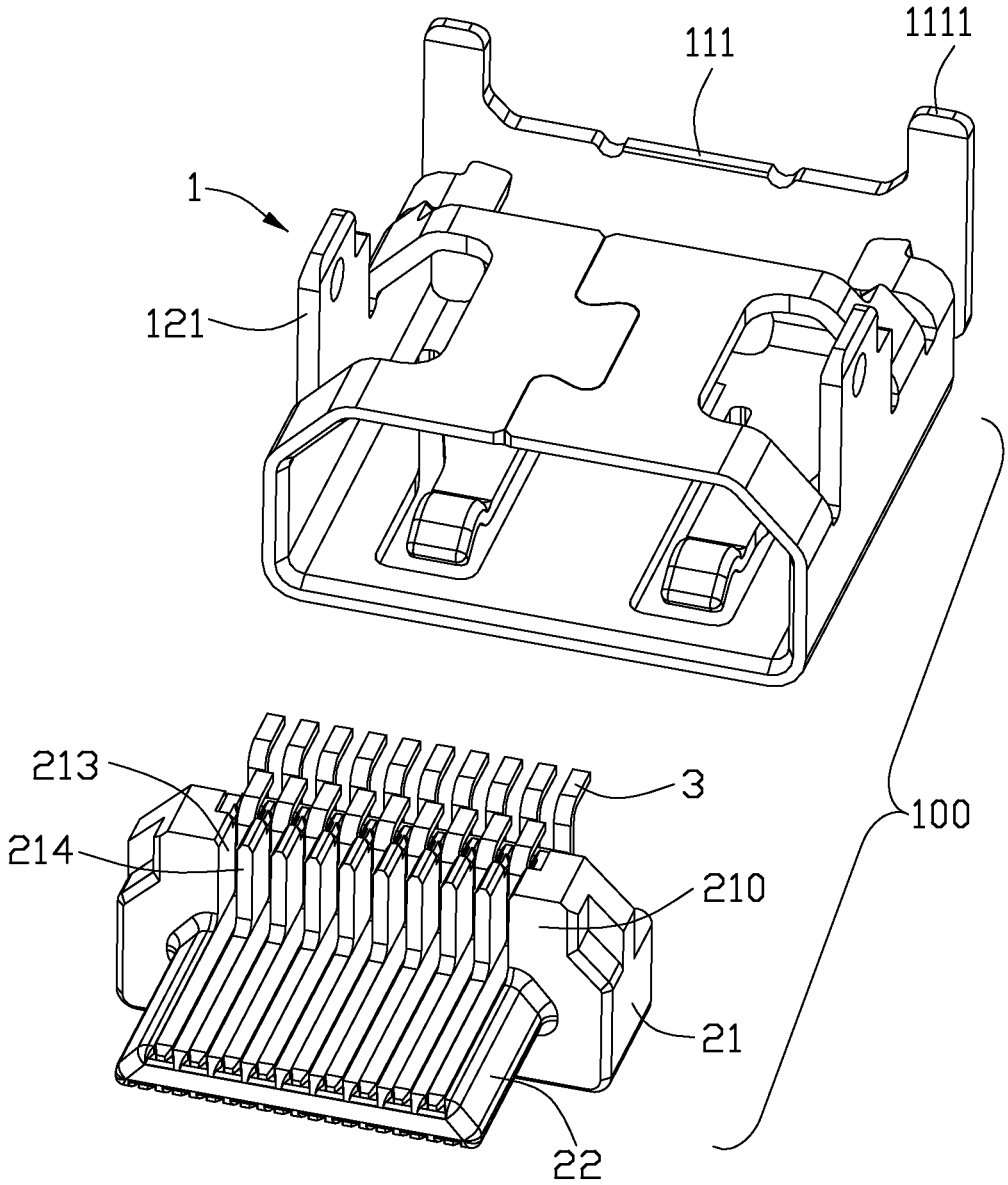
FIG. 4 is a partly exploded view of the electrical connector with a metal shell separated therefrom.
Figure 5:
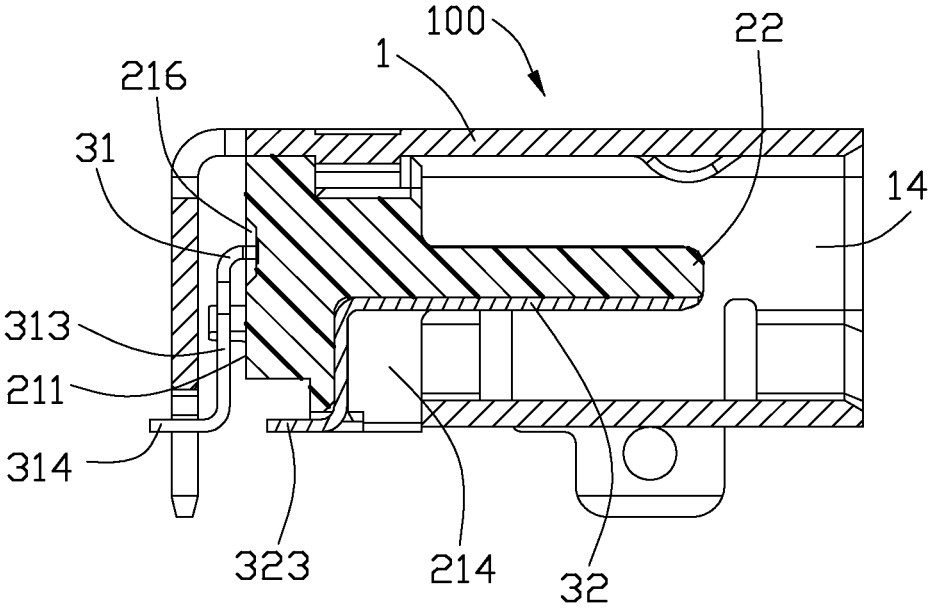
FIG. 5 is a cross-sectional view of the electrical connector taken along line 5-5 of FIG. 1.
Figure 6:
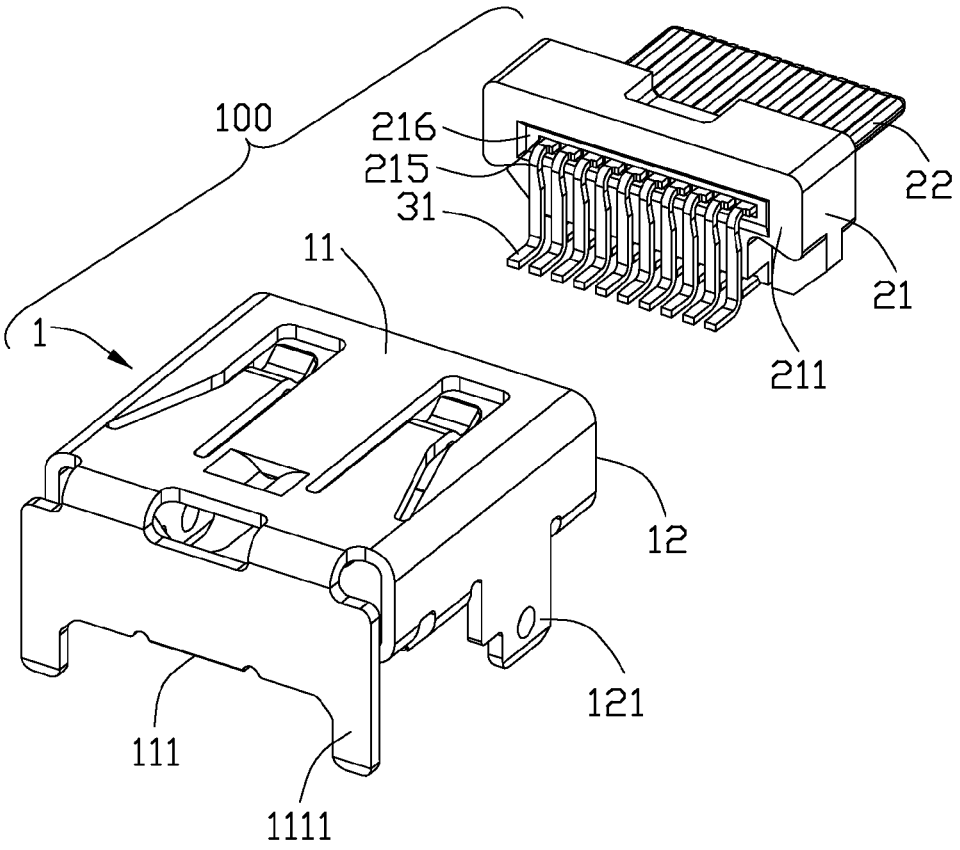
FIG. 6 is another partly exploded view of the electrical connector similar to FIG. 4, while taking from a different aspect.

Referring to FIG. 4, furthermore, the base 21 includes a plurality of second/front grooves 213 in communication with corresponding second slits 2221. Each of the second grooves 213 not only extends downwardly through the bottom face 212 of the base 21 along a vertical direction, but also extends forwardly through the front face 210 of the base 21. That is to say, the second grooves 213 are perpendicular to the second slits 2221. Besides, the base 21 includes a plurality of separate walls 214 with each of the second grooves 213 formed between adjacent two separate walls 214.

The contacts 3 include a plurality of upper contacts 31 and a plurality of lower contacts 32. Each upper contact 31 includes a flat and rigid first contacting section 311, a first fixing section 312 aligned with the first contacting section 311, a vertical section 313 bent perpendicularly and downwardly from the first fixing section 312, and a first planar soldering section 314 extending backwardly from the vertical section 313 and parallel to the first contacting section 311. Each lower contact 32 includes a flat and rigid second contacting section 321, a second fixing section 322 bent perpendicularly and downwardly from the second contacting section 321, and a second planar soldering section 323 extending backwardly from the second fixing section 322 and parallel to the second contacting section 321. The first contacting sections 311 and the second contacting sections 321 are essentially coplanar with the top surface 221 and the bottom surface 222 of the tongue portion 22, respectively.

According to the illustrated embodiment of the present invention, the upper contacts 31 are fixed in the insulative housing 2 through assembling process along a back-to-front direction. The rear opening 216 is adapted not only for easily inserting the upper contacts 31 into the insulative housing 2, but also for easily observing insertion depth of the upper contacts 31. In such assembling, the first contacting sections 311 are received in the first slits 2211 and exposed to the top surface 221, and the first fixing sections 312 are received in the first grooves 215. In order to maintain the first fixing sections 312 in the first grooves 215, each of the first fixing sections 312 includes a plurality of first projected barbs 315 for engaging with inner surfaces of the first grooves 215. The vertical sections 313 are separated a distance from the rear face 211 of the base 21 along the longitudinal direction in order that an assembling tool (not shown) may reside in the distance for regulating insertion of the upper contacts 31 and assuring coplanarity of the first planar soldering sections 314. The first planar soldering sections 314 extend adjacent to the bottom face 212. However, it is understandable that, in other embodiments, the upper contacts 31 can be fixed to the insulative housing 2 through insert-molding technology. Since insert-molding technology is well known to those of ordinary skill in the art, detailed description thereabout is omitted herein.

According to the present invention, the lower contacts 32 are assembled to the insulative housing 2 along a bottom-to-top direction. During such assembling process, the second contacting sections 321 are received in the second slits 2221 and exposed to the bottom surface 222. The second fixing sections 322 are received in the second grooves 213. The second planar soldering sections 323 extend adjacent to the bottom face 212. Most importantly, the second planar soldering sections 323 can be kept coplanar with the first planar soldering sections 314 through controlling insertion depth of the lower contacts 32 along the bottom-to-top direction. Besides, in order to maintain the second fixing sections 322 in the second grooves 213, each of the second fixing sections 322 includes a plurality of second projected barbs 325 for engaging with inner surfaces of the second grooves 213. The second fixing sections 322 are perpendicular to the first fixing sections 312.

Referring to FIG. 1, the metal shell 1 includes a top wall 11, a bottom wall 13, a pair of side walls 12 bent downwardly from lateral edges of the top wall 11, a pair of inclined walls 15 connecting the bottom wall 13 and the side walls 12, and a rear wall 111 bent downwardly from a rear edge of the top wall 11. A receiving cavity 14 is formed by such peripheral walls for receiving a mateable connector (not shown). Each side wall 12 includes a first soldering tab 121 extending along the vertical direction, and the rear wall 111 includes a pair of second soldering tabs 1111 extending along the vertical direction while the first soldering tabs 121 are perpendicular to the second soldering tabs 1111. As a result, the electrical connector 100 can be mounted on the PCB much stably.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broadest general meaning of the terms in which the appended claims are expressed.

What is claimed is:

1. An electrical connector comprising:

an insulative housing comprising a base and a tongue portion extending forwardly from the base along a longitudinal direction, the tongue portion defining a plurality of first slits and a plurality of second slits formed on top and bottom surfaces thereof, respectively, the base defining a plurality of first grooves and a plurality of second grooves, the first grooves extending along the longitudinal direction and being in communication with corresponding first slits, the second grooves extending through a bottom face of the base along a vertical direction perpendicular to the longitudinal direction and being in communication with corresponding second slits;

a plurality of upper contacts being configured to be assembled to the insulative housing along the longitudinal direction, each upper contact comprising a rigid first contacting section received in the first slit, a first fixing section fixed in the first groove and a first planar soldering section situated adjacent to the bottom face of the base;

a plurality of lower contacts being configured to be assembled to the insulative housing along the vertical direction, each lower contact comprising a rigid second contacting section received in the second slit, a second fixing section fixed in the second groove and a second planar soldering section coplanar with the first planar soldering sections; and a metal shell enclosing the tongue portion of the insulative housing to jointly form a receiving cavity for receiving a mateable connector, the first contacting sections and the second contacting sections being exposed to the receiving cavity and being essentially coplanar with the top surface and the bottom surface, respectively.

2. The electrical connector as claimed in claim 1, wherein the second grooves extend through a front face of the base and are perpendicular to the second slits.

3. The electrical connector as claimed in claim 1, wherein the base comprises a plurality of separate walls with each of the second grooves formed between adjacent two separate walls, the separate walls being exposed to the receiving cavity.

4. The electrical connector as claimed in claim 1, wherein the first fixing section of each upper contact comprises a plurality of first projected barbs for engaging with inner surfaces of the first grooves, the second fixing section of each lower contact comprises a plurality of second projected barbs engaging with inner surfaces of the second grooves, and the first fixing section is perpendicular to the second fixing section.

5. The electrical connector as claimed in claim 1, wherein the base comprises a rear face through which the first grooves extend, each upper contact comprising a vertical section connecting the first planar soldering section and the first fixing section, the vertical section being separated a distance from the rear face along the longitudinal direction.

6. The electrical connector as claimed in claim 5, wherein the base defines a rear opening and the first grooves are in communication with the rear opening.

7. The electrical connector as claimed in claim 1, wherein each side wall comprises a first soldering tab extending along the vertical direction, the metal shell further comprising a rear wall bent downwardly from a rear edge of the top wall, the rear wall comprising a pair of second soldering tabs extending along the vertical direction, the first soldering tabs being perpendicular to the second soldering tabs.

8. The electrical connector as claimed in claim 1; wherein the first contacting section extends horizontally, the first fixing section extends vertically, and the first soldering section extends horizontally to commonly define a Z like configuration of the upper contact in a side view; the second contacting section extends horizontally, the second fixing section extends vertically, and the second soldering section extends horizontally to commonly define another Z like configuration of the lower contact in the side view.

9. An electrical connector comprising:

an insulative housing comprising a base and a tongue portion extending from the base along a first direction;

a plurality of upper contacts each comprising a flat first contacting section exposed on a top surface of the tongue portion and a first planar soldering section situated adjacent to a bottom face of the base; and a plurality of lower contacts each comprising a flat second contacting section exposed on a bottom surface of the tongue portion and a second planar soldering section situated adjacent to the bottom face of the base; wherein the first contacting sections and the second contacting sections being essentially coplanar with the top surface and the bottom surface, respectively; and wherein the lower contacts and the housing are configured to have said lower contacts assembled to the insulative housing along a second direction perpendicular to the first direction in order that the second planar soldering sections are kept coplanar with the first planar soldering sections through controlling insertion depth of the lower contacts along the second direction.

10. The electrical connector as claimed in claim 9, wherein the tongue portion defines a plurality of lower slits extending along the first direction and the base defines a plurality of front grooves in communication with corresponding lower slits, the front grooves not only extending through the bottom face of the base but also extending through a front face of the base.

11. The electrical connector as claimed in claim 10, wherein the front grooves are perpendicular to the lower slits for cooperatively receiving the lower contacts.

12. The electrical connector as claimed in claim 9, wherein the upper contacts are assembled to the insulative housing along a rear-to-front direction and the lower contacts are assembled to the insulative housing along a bottom-to-top direction perpendicular to the rear-to-front direction.

13. The electrical connector as claimed in claim 9; wherein the lower contact is essentially of a Z like configuration in a side view.

14. An electrical connector comprising:

an insulative housing defining a base with a mating tongue extending forwardly therefrom, said mating tongue defining opposite upper and lower surfaces thereon;

a row of first contacts disposed in the housing, each of said first contacts defining a first contacting section exposed upon the upper surface, a first retention section located behind the first contacting section and securely received in a corresponding horizontal passageway, and a downwardly extending first tail section located behind and extending from the first retention section; and a row of second contacts disposed in the housing, each of said second contacts defining a second contacting section exposed upon the lower surface, a second retention section securely received in a vertical passageway which forwardly communicates with an exterior while being rearwardly hidden from the exterior by the base, and a second tail section located behind and extending from the second retention section; wherein the first contacts and the housing are configured to have the first contacts forwardly assembled into the housing from a rear side of the housing while the second contacts and the housing are configured to have the second contacts upwardly assembled into the housing from a bottom side of the housing.

15. The electrical connector as claimed in claim 14, wherein the second retention section is essentially perpendicular to the second contacting section.

16. The electrical connector as claimed in claim 14, wherein the first retention section lies in a horizontal plane and perpendicular to the second retention section.

17. The electrical connector as claimed in claim 14, wherein a horizontal solder section of the second tail section is located under the housing while a horizontal solder section of the first tail section is located behind the housing.

18. The electrical connector as claimed in claim 17, wherein a metallic shell encloses the housing and shields a vertical section of the first tail section while at least partially exposing the horizontal solder section of the first tail section.

19. The electrical connector as claimed in claim 14, wherein the second retention section lies in a vertical plane defined by a vertical direction and a transverse direction both of which are perpendicular to a front-to-back direction.

20. The electrical connector as claimed in claim 14, wherein both said first contact and said second contacts are essentially of a Z like configuration in a side view.

* * * * *